United States Patent [19]

Bar

[11] 4,423,405

[45] Dec. 27, 1983

[54] STARTING RELAY OF THE PTC RESISTOR TYPE IN MOTOCOMPRESSORS FOR REFRIGERATORS

[75] Inventor: Alfredo Bar, Pavia, Italy

[73] Assignee: NECCHI Societa per Azioni, Pavia, Italy

[21] Appl. No.: 377,051

[22] Filed: May 11, 1982

[30] Foreign Application Priority Data

May 20, 1981 [IT] Italy ..... 42911 A/81

[51] Int. Cl.[3] ..... H01C 7/02

[52] U.S. Cl. ..... 338/25; 338/22 R; 338/220

[58] Field of Search ..... 338/25, 22 R, 22 SD, 338/220; 417/32

[56] References Cited

U.S. PATENT DOCUMENTS 4,131,871 12/1978 Haag et al. ..... 338/220

FOREIGN PATENT DOCUMENTS 2849584 5/1979 Fed. Rep. of Germany ..... 338/220

*Primary Examiner*—C. L. Albritton

*Attorney, Agent, or Firm*—Stevens, Davis, Miller & Mosher

[57] ABSTRACT

Starting relay of the PTC resistor type provided on a monophase electric motor of the induction type for motorcompressors for refrigerators. This positive temperature coefficient resistor in the shape of a small cylinder is built-in on the collector of the motor feed connectors (cluster) arranged inside the container of the motorcompressor on the hermetic electrical connection fastened on the wall of the same container.

1 Claim, 4 Drawing Figures

STARTING RELAY OF THE PTC RESISTOR TYPE IN MOTOCOMPRESSORS FOR REFRIGERATORS

DISCLOSURE OF THE INVENTION

The present invention relates to a starting relay of the positive temperature coefficient resistor type in motor-compressors for refrigerators.

For some years positive temperature coefficient resistors have been in common use as starting relays of monophase induction motors operating motorcompressors used in the refrigerator units.

The resistor having the shape of a tablet, is contained in a suitable casing provided outside the shell.

Such an arrangement causes some drawbacks, particularly for the outrigger in the shell and some complications in the electrical circuit.

An object of the present invention is to improve the use of a PTCR type of starting relay in the field of the sealed motorcompressors. The technical problem to be solved in order to attain the forementioned object was to find a rational arrangement of the PTCR inside the shell in such a way as to assure the perfect working of the starting relay which could be compromised by the particular temperature conditions existing in the shell.

The solution of the technical problem disclosed is to embody the said temperature coefficient resistor in the cluster connected on the pins provided on the hermetic electrical connection fastened on the wall of the same container.

Other details and features of the invention will stand out from the description given below by way of non-limitative example and with reference to the accompanying drawings, in which.

Figure 1:
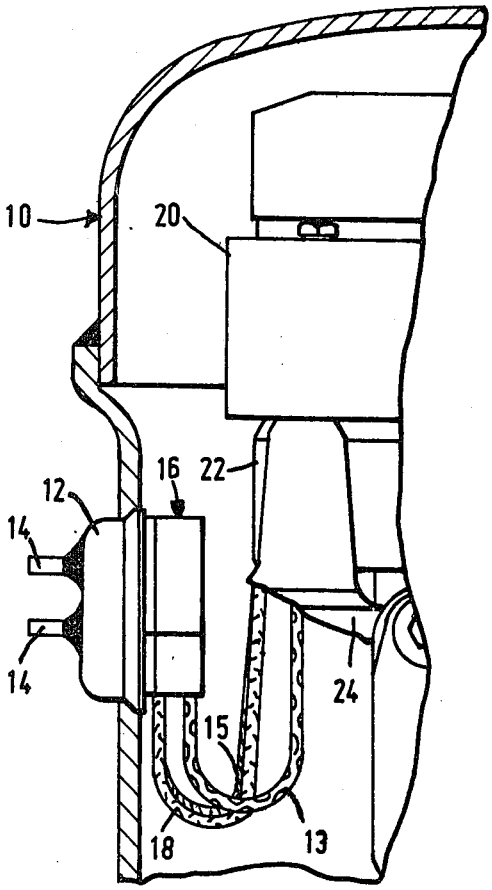
FIG. 1 shows a partial view of the motorcompressor and of the connector-starting relay assembly.

With reference to FIG. 1 numeral 10 indicates the container or shell of the motorcompressor. A hermetic electrical connection 12, provided with two pins 14 acts as an electrical and hermetic connection between the inside and the outside of the shell.

Figure 2:
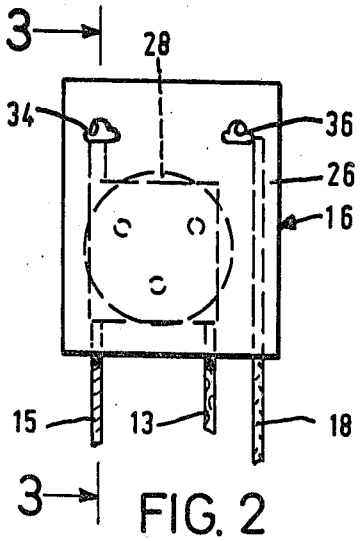
FIG. 2 shows the connector-starting relay assembly.
Figure 3:
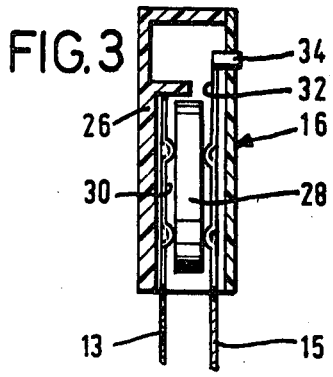
FIG. 3 is a view of the assembly of FIG. 2 sectioned along line 3—3.
Figure 4:
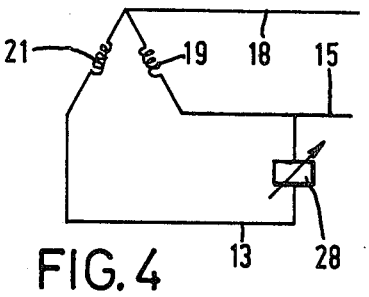
FIG. 4 shows the motor feed wiring diagram.

Grafted in the collector of the motor feed connectors, inside the shell, is shown the PTCR-cluster assembly 16, conductors 18, 15 and 13 being connected therewith for feeding windings 19 and 21 (FIG. 4) of stator 20. Stator 20 is supported by two columns provided on the body 24 which is, in its turn, resiliently resting in a usual way on the bottom of the shell 10. The PTCR-cluster assembly in shown in detail in FIGS. 2 and 3. It provides a box 26 of plastic material inside of which a tablet 28 is arranged having the shape of a disc. Conducting plates 30 and 32 urge against the opposite base surfaces of the disc and are connected to the cables 15 and 13 leading to the main winding 19 and starting winding 21 of the motor.

On a wall of the box there are two bores 34 and 36 suitable to couple with two pins (not shown) on the portion of collector 12 inside the shell 10 electrically connected to the pins 14.

The common conductor 18 is electrically connected to the bore 36 and the conductor 13 to the bore 34. By the arrangement of the PTCR-cluster the outrigger outside the shell diminishes, and simplifies the electrical feeding circuit by reducing to two the number of conductors provided inside the same shell.

The correct working of the PTCR is insured by the fact that, in spite of the rather high inside temperature of the shell, the tablet 28 can reach the conduction temperature quickly, either because of its closeness to the shell wall, or because of the action of the refrigerant gas cold stream flooding it while on the way to the suction chamber, during the standstill period of the motor before the beginning of a new cooling cycle.

What is claimed is:

1. Starting relay of the resistor type with positive temperature coefficient in motor compressors for refrigerators, comprising a hermetically sealed walled container, a two-pin electrical connection fastened on the outside of said container, on the inside of said container a collector of three motor feed connectors, pins provided on the hermetic electrical connection fastened on the wall of said container and a disc resistor embodied in the collector positioned between two of the motor feed connectors.

* * * * *